US012497964B2

(12) United States Patent
Wu et al.

(10) Patent No.: US 12,497,964 B2
(45) Date of Patent: Dec. 16, 2025

(54) ROTARY COMPRESSOR

(71) Applicant: RECHI PRECISION CO., LTD., Taoyuan (TW)

(72) Inventors: Tsan-Chuan Wu, Taoyuan (TW); Wen-Jen Kuo, Taoyuan (TW); Zheng-Bo Liu, Taoyuan (TW); Chia-Pin Chang, Taoyuan (TW); Hsi-Kun Hsu, Taoyuan (TW); Shun-Yung Huang, Taoyuan (TW)

(73) Assignee: RECHI PRECISION CO., LTD., Taoyuan (TW)

( * ) Notice: Subject to any disclaimer, the term of this patent is extended or adjusted under 35 U.S.C. 154(b) by 0 days.

(21) Appl. No.: 18/971,554

(22) Filed: Dec. 6, 2024

(65) Prior Publication Data

US 2025/0243863 A1 Jul. 31, 2025

(30) Foreign Application Priority Data

Jan. 26, 2024 (TW) ..... 113103047

(51) Int. Cl.
*F04C 18/356* (2006.01)
*F04C 29/00* (2006.01)
*F04C 29/12* (2006.01)

(52) U.S. Cl.
CPC ..... *F04C 18/3564* (2013.01); *F04C 29/0092* (2013.01); *F04C 29/126* (2013.01)

(58) Field of Classification Search
CPC .. F04C 18/3564; F04C 23/001; F04C 23/008; F04C 28/08; F04C 28/10–26; F04C 29/0092; F04C 29/126
See application file for complete search history.

(56) References Cited

U.S. PATENT DOCUMENTS 10,309,700 B2 6/2019 Lee et al.
2009/0155112 A1* 6/2009 Byun ..... F04C 18/3564 418/23
2010/0189584 A1* 7/2010 Byun ..... F04C 18/3564 418/13

(Continued)

FOREIGN PATENT DOCUMENTS

CN 208268068 U 12/2018
TW I656310 B 4/2019

*Primary Examiner* — Craig M Schneider

(74) *Attorney, Agent, or Firm* — MUNCY, GEISSLER, OLDS & LOWE, P.C.

(57) ABSTRACT

A rotary compressor comprises a housing, a motor, a compression pump located within the housing and a high-pressure chamber communication unit located on one side of the housing. When the rotary compressor is not in the start-up state, a solenoid valve of the high-pressure chamber communication unit is activated, so that the low-density refrigerant gas in the housing of the rotary compressor will be transferred to the bypass port through the connecting tube located in the inner space of the housing and enters the compression chamber of the cylinder of the compression pump 0~180 seconds prior to the start-up time, which reduces the quality of the refrigerant in the suction-compression-exhaust cycle, and at the same time reduces the high and low pressure difference during the start-up period. The solenoid valve is then closed to reduce the start-up and maximum torque required during this period.

10 Claims, 13 Drawing Sheets

(56) References Cited

U.S. PATENT DOCUMENTS

| | | | | |
|---|---|---|---|---|
| 2011/0138848 | A1* | 6/2011 | Byun | F04C 18/3564 418/23 |
| 2014/0099218 | A1* | 4/2014 | Hiwata | F04C 28/24 417/410.3 |
| 2017/0248356 | A1* | 8/2017 | Lee | F04C 18/3564 |

* cited by examiner

ROTARY COMPRESSOR

RELATED APPLICATIONS

This application claims priority to Taiwan Application Serial Number 113103047, filed Jan. 26, 2024, which is herein incorporated by reference.

BACKGROUND

Technical Field

The present disclosure relates to a compressor, especially relates to a rotary compressor.

Description of Related Art

The existing rotary compressor mainly includes the following components: exhaust pipe, casing, motor (stator, rotor), crankshaft, upper bearing, muffler, compression unit (cylinder, rings, vanes), lower bearing, bottom cover, outlet pipe, liquid reservoir and inlet pipe. The basic working principle of the compressor is as follows: when the compressor is energized, the stator generates a magnetic field, which rotates the rotor, drives the crankshaft, and causes the rings to move eccentrically in the cylinder, thus compressing the low-temperature and low-pressure gas into a high-temperature and high-pressure gas. The gas is then discharged from the cylinder through the muffler and into the shell, and then through a cut edge on the outside of the stator and the gap between the rotor, and then discharged into the refrigeration cycle system through the outlet pipe.

As the rotary compressor is started by a coil energized to bring the rotor of the motor into rotary motion, which in turn drives the crankshaft drive thereby driving a ring in the cylinder to do eccentric motion for compression, and a suction chamber and a compression chamber are formed by the vane separating the suction fluid and the compression fluid, and when the fluid in the compression chamber reaches the exhaust pressure in the housing of the compressor and the exhaust valve is resisted, the exhaust valve is opened for continuous suction and exhaust cycle. However, a start-up failure occurs when the direct suction of refrigerant oil or liquid refrigerant during start-up causes the mass flow rate to be loaded by the compressor greater than the motor's start-up torque/maximum torque; and raising the motor's start-up torque/maximum torque will in turn cause a deterioration of the compressor's energy efficiency. Therefore, there is a need for developers and researchers in the compressor industry to continue to solve the above problems.

SUMMARY

This Summary is provided merely to summarize some example embodiments, so as to provide a basic understanding of some aspects of the subject matter described in the present disclosure. Accordingly, the features described in this Summary are merely examples and should not be construed to narrow the scope or spirit of the subject matter described herein in any way. Other features, aspects, and advantages of the subject matter described herein will become apparent from the following Detailed Description, Figures, and Claims.

According to one aspect of the present disclosure, a rotary compressor includes a housing, a motor, a compression pump and a high-pressure chamber communication unit. The housing includes an outlet pipe. The motor is located in the housing. The compression pump is located in the housing and below the motor, and the compression pump includes a cylinder, a ring, a vane, at least one spring, an upper support, a lower support and a crankshaft. The cylinder includes a first end portion and a second end portion. The cylinder includes a compression chamber located in a center of the cylinder and running through an upper and a lower end of the cylinder. The compression chamber includes a vane groove, a spring hole, a suction hole and a bypass port, wherein the spring hole is communicated with the vane groove, the suction hole, the vane groove and the spring hole are independent of each other and are not communicated with each other. The ring is rotatably located in the compression chamber of the cylinder. The vane is reciprocally moved in the vane groove of the cylinder, a front end of the vane and a peripheral surface of the ring are in contact with each other. The at least one spring is located at a back end of the vane. The upper support is located in the housing and above the cylinder. The lower support is located in the housing and below the cylinder. The crankshaft is located in the housing for disposing the upper support, the motor, the ring and the lower support. The high-pressure chamber communication unit is located on one side of the housing, wherein the high-pressure chamber communication unit is communicated with a space inside the housing and to a bypass port of the cylinder of the compression pump, so as to enable a refrigerant gas from the space inside the housing flow to the bypass port and flow enter into the compression chamber.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
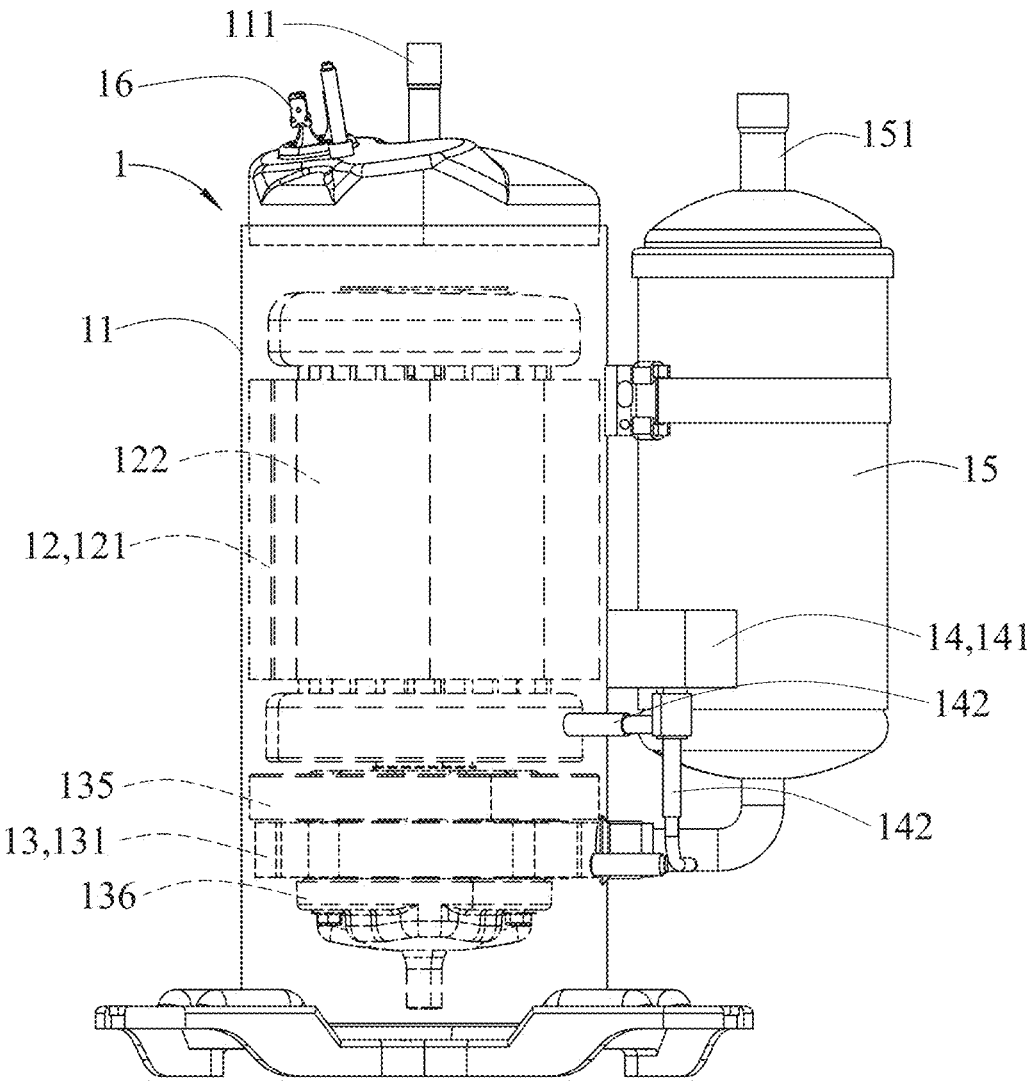
FIG. 1 is a schematic view of a rotary compressor of the present disclosure.
Figure 2:
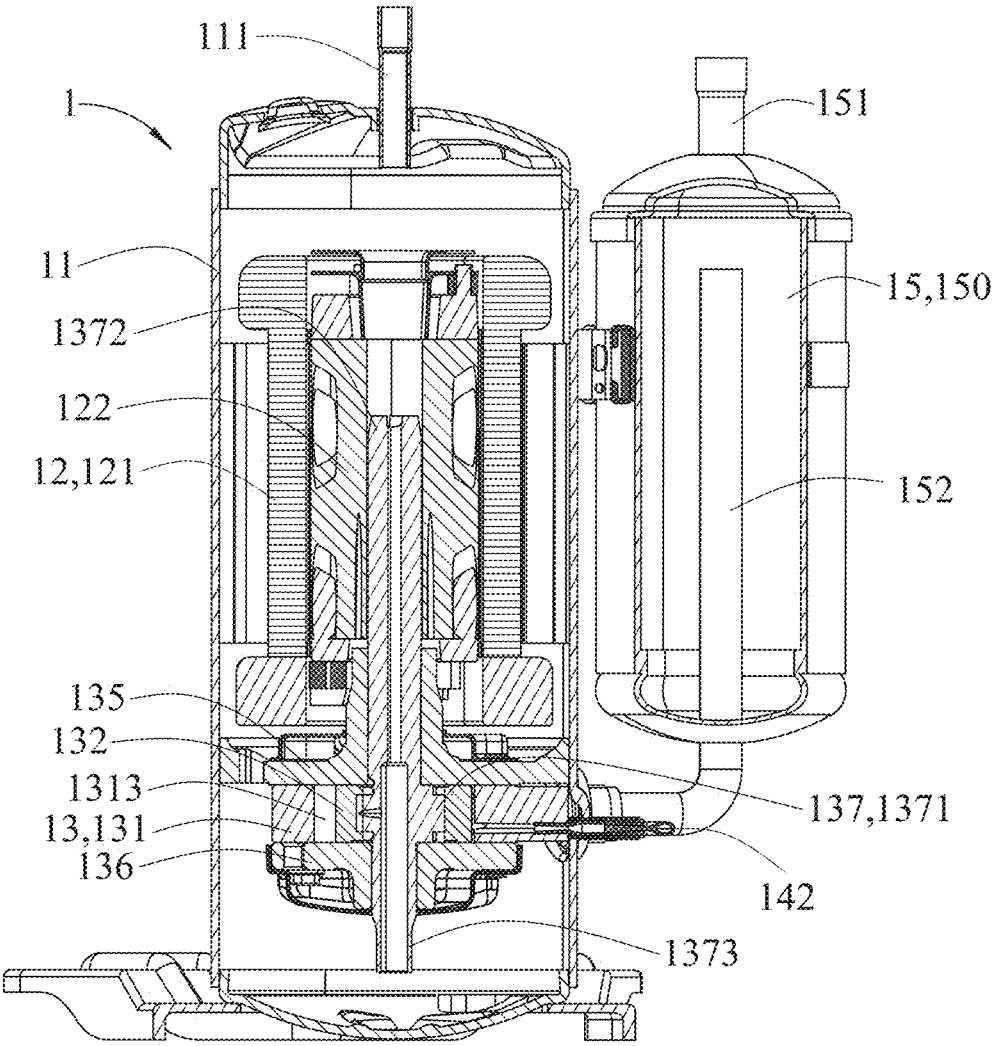
FIG. 2 is a cross-sectional view of the rotary compressor of the present disclosure.
Figure 3:
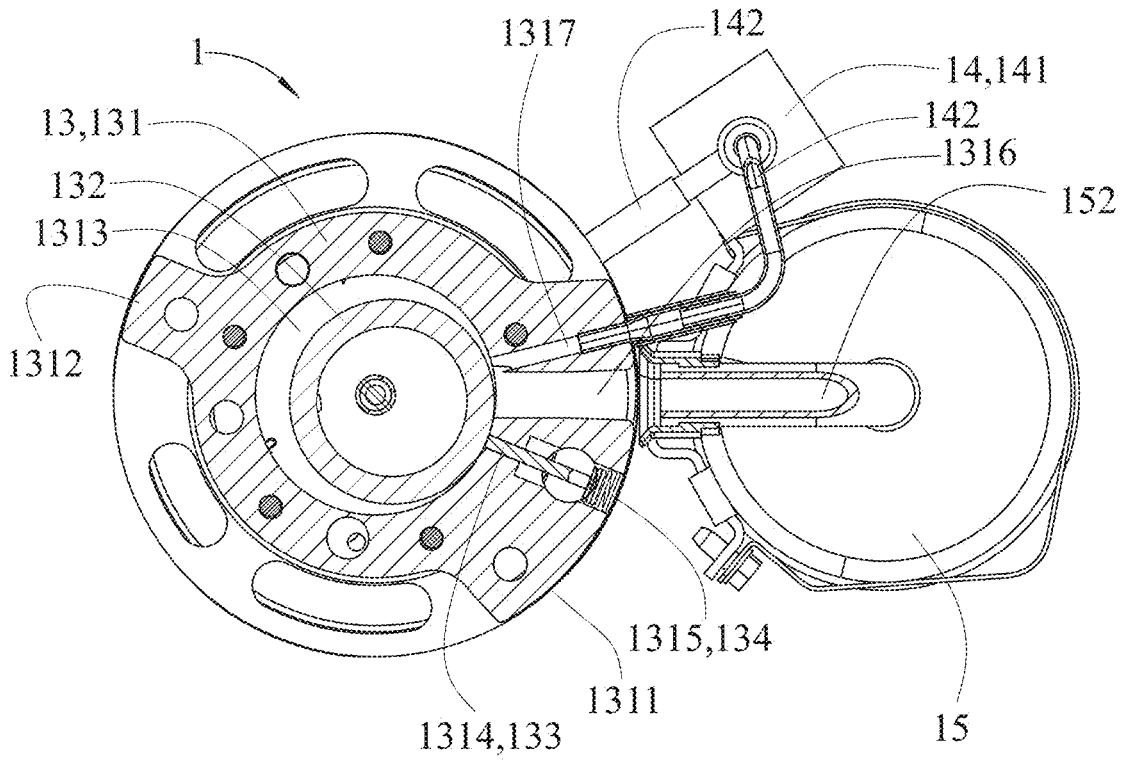
FIG. 3 is an elevation-section view of the rotary compressor of the present disclosure.

Multiple embodiments of the present disclosure will be described below by reference to the drawings. For the sake of clarity, many practical details will be described in the following description. It should be appreciated, however, that these practical details should not be used to limit the present disclosure. That is, in some embodiments of the present disclosure, these practical details are not necessary. In addition, in order to simplify the drawings and to focus on the main technical features of the present disclosure, some of the customary and non-essential structures and components will be shown in the drawings in a simple schematic manner or will be omitted.

Referring to FIG. 1 to FIG. 11. The rotary compressor 1 includes a housing 11, a motor 12, a compression pump 13 and a high-pressure chamber communication unit 14. The rotary compressor 1 can be a vertical type compressor or a horizontal type compressor, in the present disclosure, the rotary compressor 1 is a vertical type compressor.

The housing 11 has a hollow body and is used to accommodate the motor 12, the compression pump 13 and other components. The housing 11 includes an outlet pipe 111, which is located at the top end or the side of the housing 11. In the embodiment of present disclosure, the outlet pipe 111 is located at the top end of the housing 11, and the bottom end of the housing 11 can be used to store refrigerator oil. The housing 11 may be of various commercially available structural types and is not limited to such structural types.

The motor 12 is disposed within the housing 11. The motor 12 includes a stator 121 and a rotor 122. The stator 121 is fixed to an inner wall of the housing 11, and the rotor 122 is rotationally disposed on an inner side of the stator 121. The motor 12 may be of various commercially available structural types and is not limited to such structural types.

The compression pump 13 is located in the housing 11. The compression pump 13 is located under the motor 12, and the compression pump 13 includes a cylinder 131, the cylinder 131 is located in the housing 11, and is located under the motor 12. The cylinder 131 includes a first end portion 1311 and a second end portion 1312. A center of the cylinder 131 includes a compression chamber 1313 which runs through the upper and lower ends. A wall of the compression chamber 1313 includes a vane groove 1314, a spring hole 1315, a suction hole 1316 and a bypass port 1317. The spring hole 1315 does not completely penetrate through the wall of the compression chamber 1313. The spring hole 1315 is communicated with the vane groove 1314, and the suction hole 1316, the vane groove 1314 and the spring hole 1315 are independent of each other and are not communicated with each other. A ring 132 is rotatably disposed in the compression chamber 1313 of the cylinder 131. A vane 133 is movably disposed in the vane groove 1314 of the cylinder 131, and a front end of the vane 133 and a peripheral surface of the ring 132 are in contact with each other, dividing the compression chamber 1313 into a suction chamber and a compression chamber. At least one spring 134 is located in the spring hole 1315, and the spring 134 is located at a rear end of the vane 133, so that the front end of the vane 133 and the outer peripheral surface of the ring 132 are in contact with each other, and the rear end of the spring 134 and the inner wall of the housing 11 are in contact with each other. The spring 134 can be stretched within the spring hole 1315, so that the front end of the vane 133 contacts the inner peripheral surface of the ring 132, and the front end of the vane 133 is rotated eccentrically in the compression chamber 1313. An upper support 135 is located in the housing 11 and above the cylinder 131. A lower support 136 is located in the housing 11 and below the cylinder 131. A crankshaft 137 extends along a longitudinal direction for an appropriate length. The crankshaft 137 is located in the housing 11. The crankshaft 137 includes at least one eccentric portion 1371 located at an appropriate distance from the lower end of the crankshaft 137, so that the crankshaft 137 defines an upper shaft section 1372 and a lower shaft section 1373. The upper shaft section 1372 is for disposing the upper support 135 and the rotor 122 of the motor 12, the lower shaft section 1373 is for disposing the lower support 136, and the eccentric section 1371 is for disposing the ring 132 of the cylinder 131.

There is no limit to the number of cylinder 131 and ring 132. For example, the compression pump 13 can be of a single-cylinder, a double-cylinder, or a triple-cylinder type or of more cylinders, and the cylinder 131 and the ring 132 can be correspondingly set to one, two, or three or more. The number of the ring 132 is determined in accordance with the type of the cylinder 131 and is rotatably disposed in the compression chamber 1313 of the cylinder 131.

The high-pressure chamber communication unit 14 is located on one side of the housing 11. The high-pressure chamber communication unit 14 is communicated with the space inside the housing 11 and to the bypass port 1317 of the cylinder 131 of the compression pump 13, so as to transfer the refrigerant gas in the space inside the housing 11 to the bypass port 1317 to enter into the compression chamber 1313. The high-pressure chamber communication unit 14 includes a solenoid valve 141 and two connecting tubes 142. The two connecting tubes 142 are made of metal, one end of one of the connecting tubes 142 extends to the space inside the housing 11, one end of the other of the connecting tubes 142 is communicated with the bypass port 1317 of the cylinder 131 of the compression pump 13, so that the two connecting tubes 142 are located at one side of the housing 11. The solenoid valve 141 is located at the two connecting tubes 142, so that the solenoid valve 141 is located outside of the housing 11.

More details are further explained in the following paragraphs in accordance with the structure described above.

In the embodiment, the rotary compressor 1 further includes a filter bottle 15, which is made of metal material. The filter bottle 15 is formed by extending an appropriate length in a longitudinal direction, and an inner space 150 is defined therein. An inlet pipe 151 is disposed at the top end of the filter bottle 15, and at least one inner pipe 152 is located inside the filter bottle 15. The inner pipe 152 of the filter bottle 15 extends from outside of the filter bottle 15 and into the housing 11, and is communicated with the suction hole 1316 of the cylinder 131 of the compressor 13, so that the filter bottle 15 is located on one side of the housing 11, and the low pressure gas (refrigerant) inside the filter bottle 15 is transferred to the suction hole 1316 of the cylinder 131 of the compression pump 13 by the inner pipe 152 of the filter bottle 15, and then to the compression chamber 1313 to be continuously compressed to a certain pressure, and then outputted to the space inside the housing 11. In more detail, the inner pipe 152 of the filter bottle 15 and the compression pump 131 of the cylinder 131 are in a communication state, and a refrigeration circulation system is connected between the inner pipe 152 of the filter bottle 15 and the outlet pipe 111 of the housing 11 of the compressor 1. There is no limit of the number of the inner pipe 152 of the filter bottle 15. The number of the inner pipe 152 of the filter bottle 15 can be in accordance with a single-cylinder, a double-cylinder, or more than three-cylinder compression pump 13. The filter bottle 15 may be of various commercially available structural types, and there is no limitation on its structural type.

In the embodiment, the rotary compressor 1 further includes an electrical connector assembly 16, which is disposed at the top or side of the housing 11. In one example, the electrical connector assembly 16 is disposed at the top of the housing 11 and is electrically coupled to the motor 12. The electrical connector assembly 16 may be of various commercially available structural types, and there is no limitation on its structural type.

The structure of the cylinder 131 of the compression pump 13 is further described as follows.

In the embodiment, the suction hole 1316, the bypass port 1317, the vane groove 1314 and the spring hole 1315 are located at the first end portion 1311 of the cylinder 131. The suction hole 1316 and the vane groove 1314 are communicated in the compression chamber 1313, and a first imaginary line L1 and a second imaginary line L2 are defined at the first end portion 1311 of the cylinder 131. The first imaginary line L1 extends left and right, the second imaginary line L2 extends up and down, and the first imaginary line and the second imaginary line intersect at a center C1 of the suction hole 1316, thereby defining a first area A1, a second area A2, a third area A3, and a fourth area A4 around the suction hole 1316.

Figure 4:
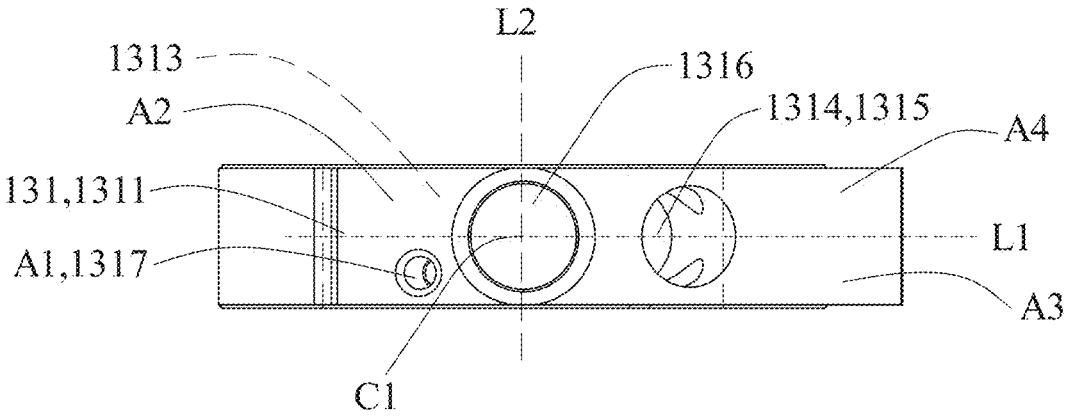
FIG. 4 is a schematic view of a first type structure of the cylinder of the rotary compressor of the present disclosure.
Figure 6:
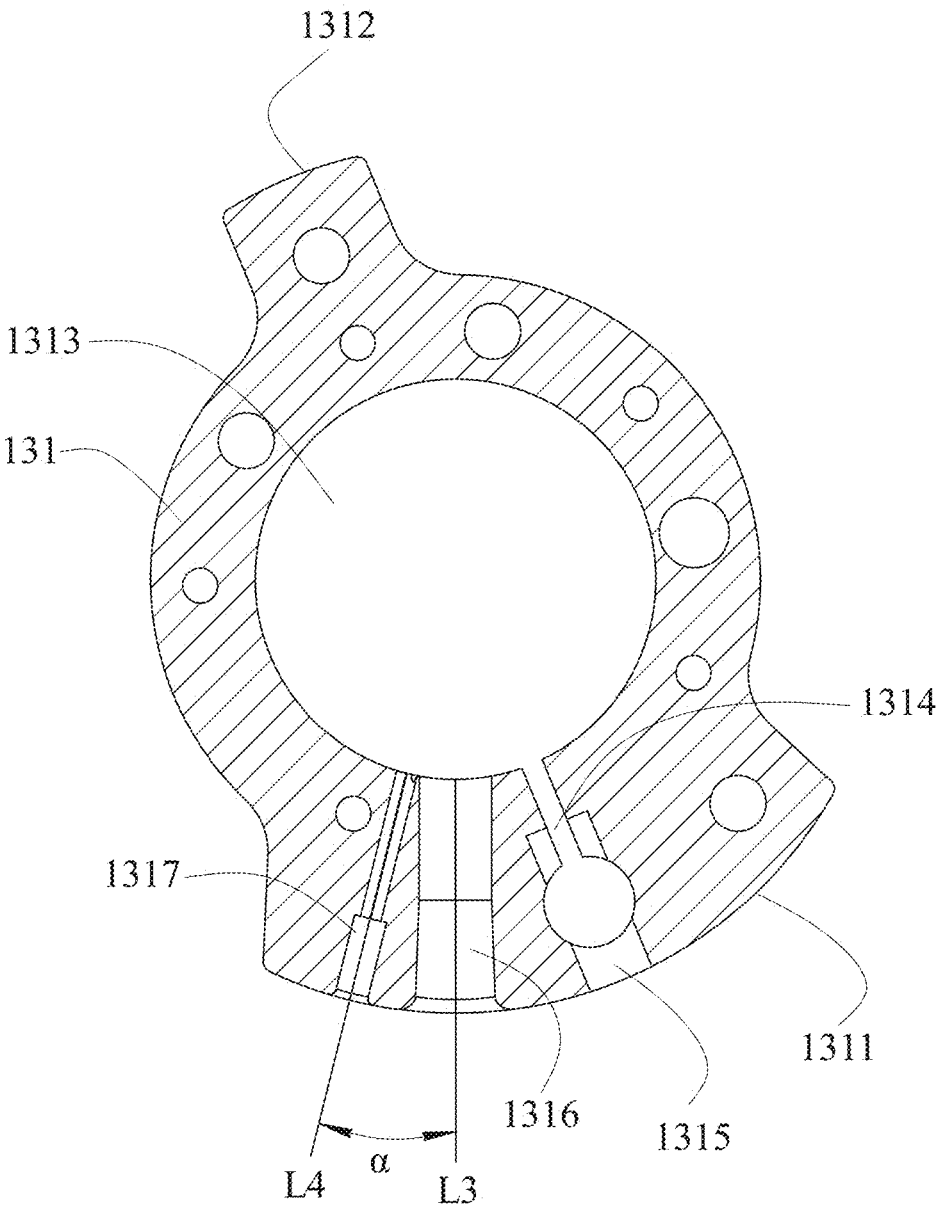
FIG. 6 is a cross-sectional view (I) of FIG. 4 and FIG. 5 of the present disclosure.
Figure 7:
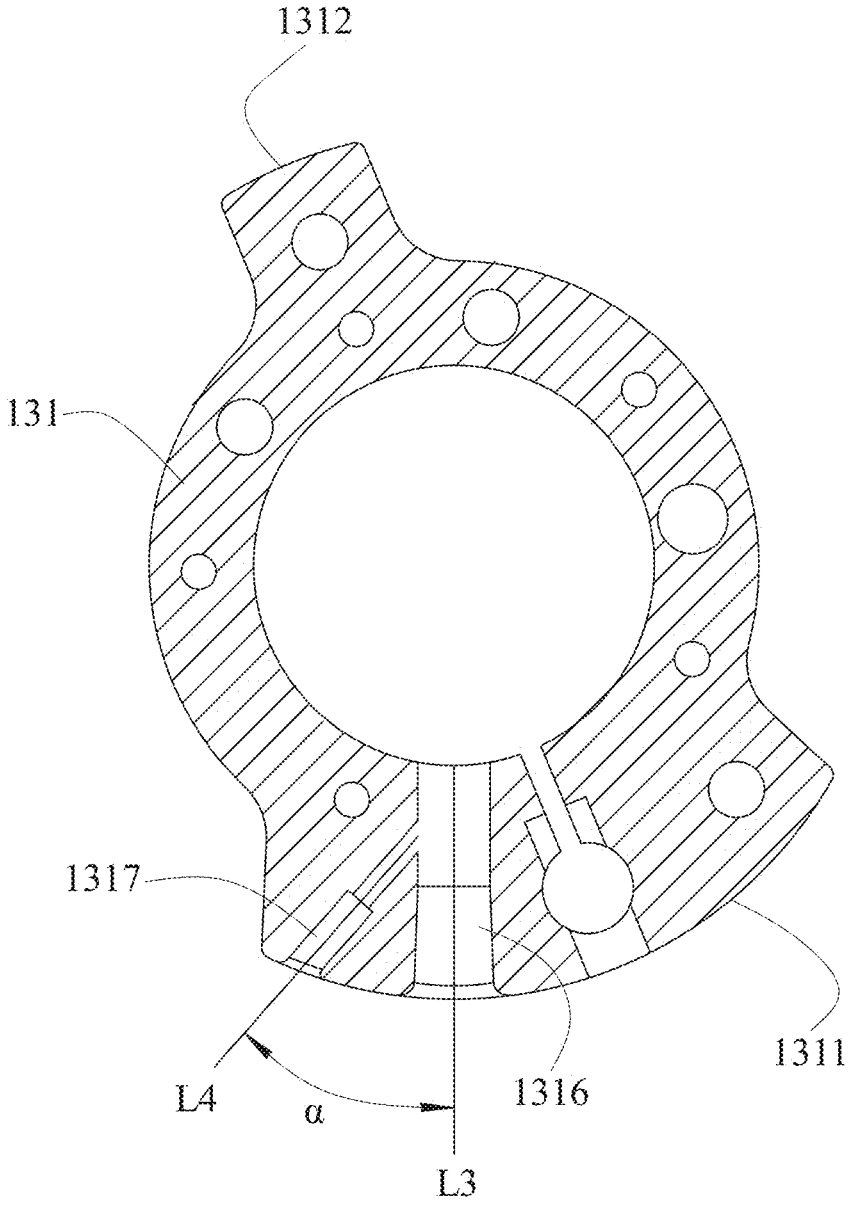
FIG. 7 is a cross-sectional view (II) of FIG. 4 and FIG. 5 of the present disclosure.

Type I: when the bypass port 1317 is located in the first area A1 (as shown in FIG. 4), the bypass port 1317 is communicated with the compression chamber 1313 or the suction hole 1316. In other words, the bypass port 1317 is communicated with the compression chamber 1313, or the bypass port 1317 is communicated with the suction port 1316. Whether the bypass port 1317 is communicated with the compression chamber 1313 (as shown in FIG. 6) or the bypass port 1317 is communicated with the suction hole 1316 (as shown in FIG. 7), a center line of the suction hole 1316 is L3, a center line of the bypass port 1317 is L4, and an angle between the center line L3 of the suction hole 1316 and the center line L4 of the bypass port 1317 is $\alpha$, and following condition is satisfied: $10° < \alpha < 70°$ (as shown in FIG. 6 and FIG. 7).

Figure 5:
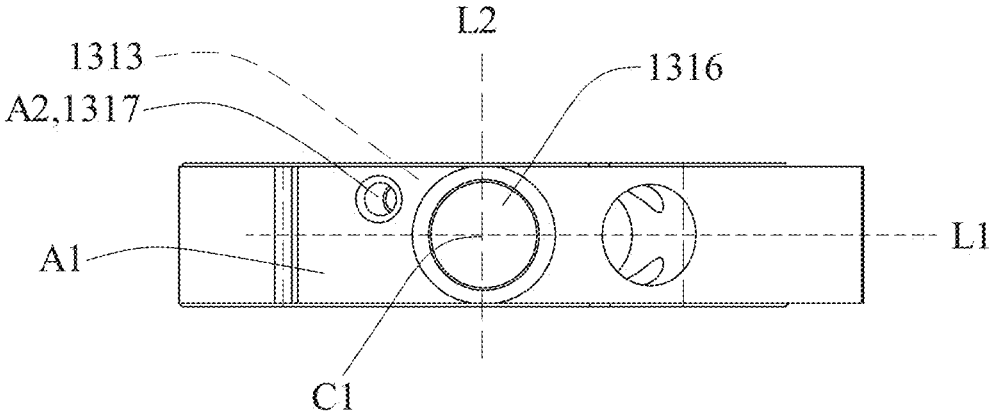
FIG. 5 is a schematic view of a second type structure of the cylinder of the rotary compressor of the present disclosure.

Type II: Since the first area A1 and the second area A2 are located on the same side of the suction hole 1316, when the bypass port 1317 is located in the second area A2 (as shown in FIG. 5), the bypass port 1317 is communicated with the compression chamber 1313 or the suction hole 1316. In other words, the bypass port 1317 is communicated with the compression chamber 1313 or the bypass port 1317 is communicated with the suction hole 1316. Whether the bypass port 1317 is communicated with the compression chamber 1313 (as shown in FIG. 6) or the bypass port 1317 is communicated with the suction hole 1316 (as shown in FIG. 7), a center line of the suction hole 1316 is L3, a center line of the bypass port 1317 is L4, an angle between the center line L3 of the suction hole 1316 and the center line L4 of the bypass port 1317 is $\alpha$, and following condition is satisfied: $10° < \alpha < 70°$ (as shown in FIG. 6 and FIG. 7).

Figure 8:
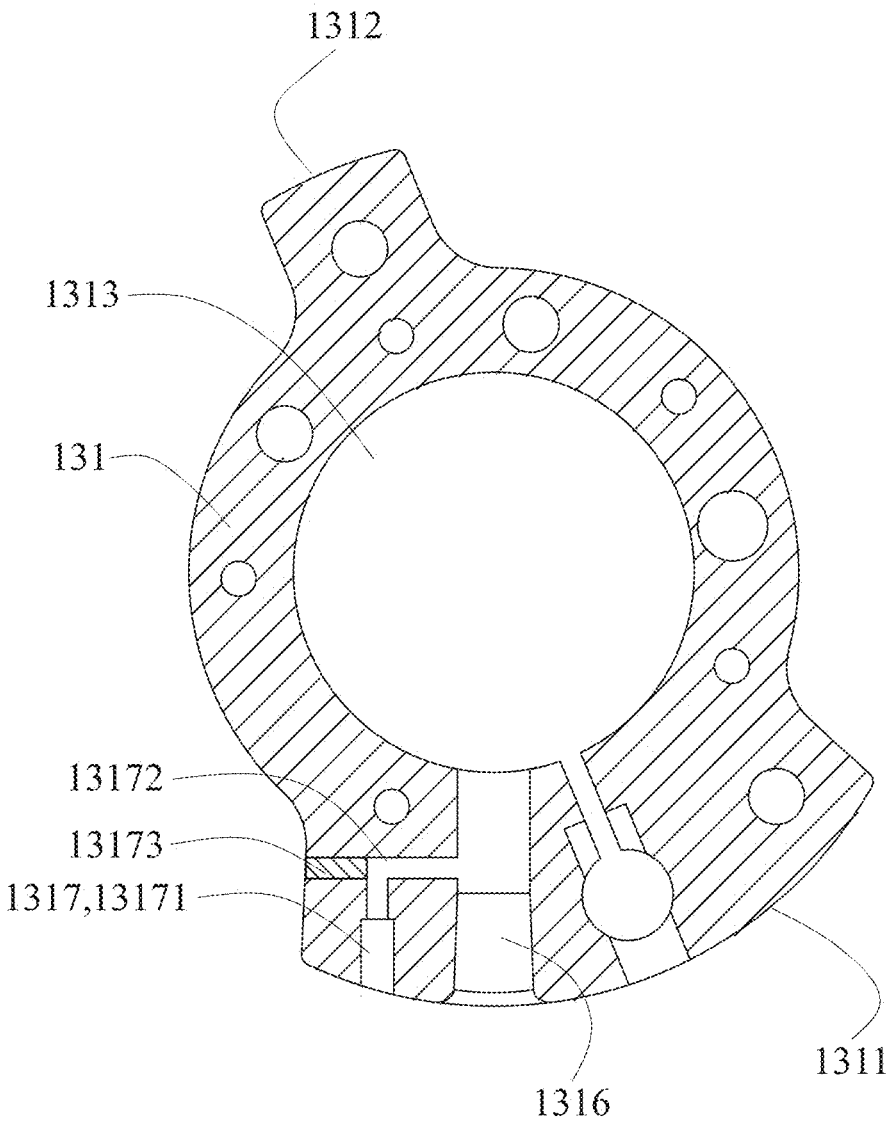
FIG. 8 is a cross-sectional view (III) of FIG. 4 and FIG. 5 of the present disclosure.

In addition, as described above, whether the bypass port 1317 is located in the first area A1 (as shown in FIG. 4) or the second area A2 (as shown in FIG. 5), the bypass port 1317 is L-shaped and is communicated with the suction hole 1316 (as shown in FIG. 8). In more detail, the L-shaped bypass port 1317 is formed by a first passageway 13171 and a second passageway 13172. The first passage 13171 extends from the bypass port 1317 toward the compression chamber 1313 of the cylinder 131, but is not communicated with the compression chamber 1313. The second passage 13172 extends from a side of the first end portion 1311 of the cylinder 131 toward the suction hole 1316 and is communicated with the suction hole 1316. The first passageway 13171 and the second passageway 13172 will intersect to form a L shape, and a plug 13173 is located on a side of the second passageway 13172 toward the first end portion 1311 of the cylinder 131 to prevent the refrigerant gas from flowing out.

Figure 9:
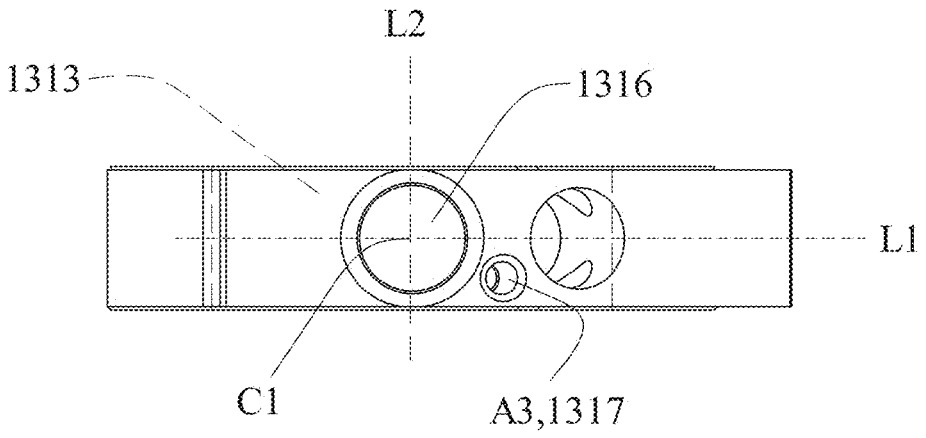
FIG. 9 is a schematic view of a third type structure of the cylinder of the rotary compressor of the present disclosure.
Figure 11:
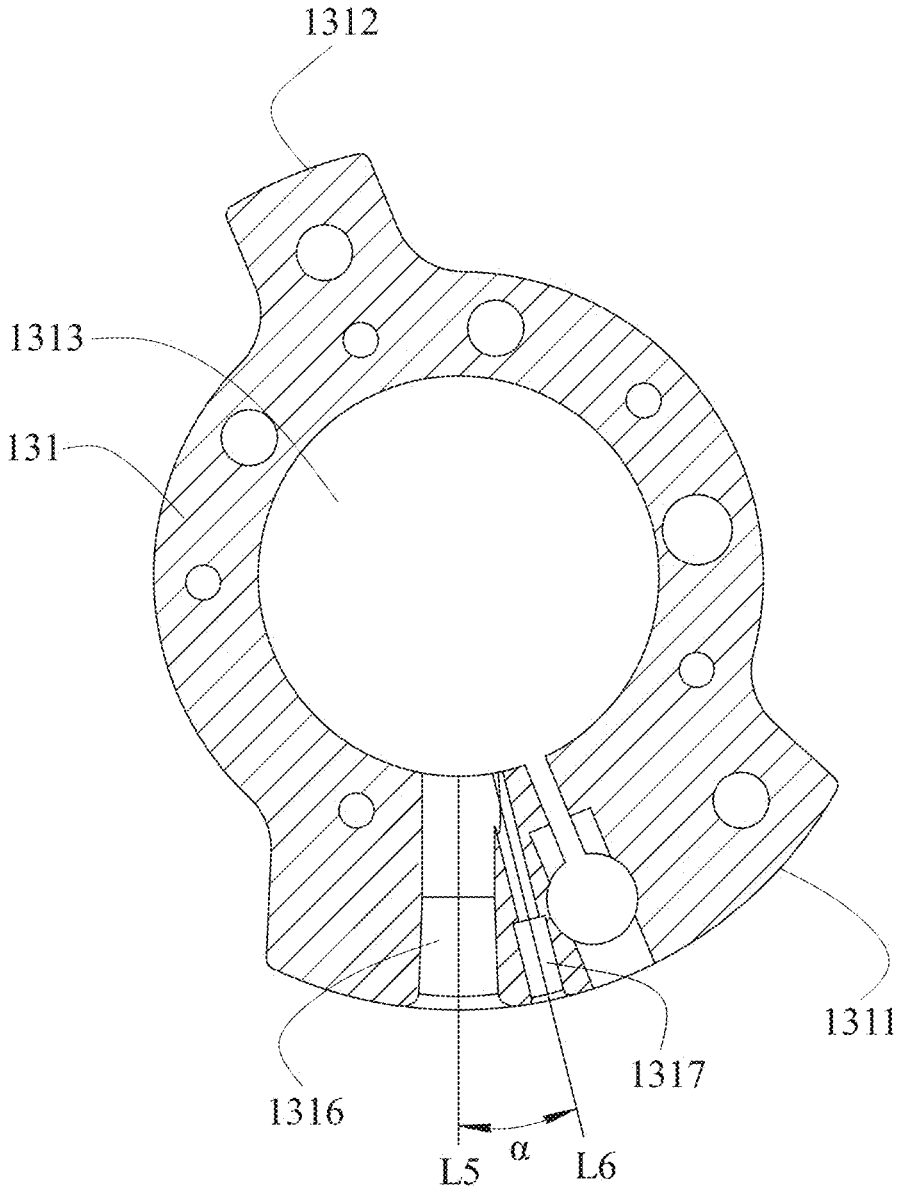
FIG. 11 is a cross-sectional view of FIG. 9 and FIG. 10 of the present disclosure.

Type III: When the bypass port 1317 is located in the third area A3 (as shown in FIG. 9), the bypass port 1317 is communicated with the compression chamber 1313 or the suction hole 1316. In other words, the bypass port 1317 is communicated with the compression chamber 1313, or the bypass port 1317 is communicated with the suction hole 1316. In the embodiment, the bypass port 1317 is communicated with the suction hole 1316 (as shown in FIG. 11). Whether the bypass port 1317 is communicated with the compression chamber 1313 or the bypass port 1317 is communicated with the suction hole 1316 (as shown in FIG. 11), a center line of the suction hole 1316 is L5, a center line of the bypass port 1317 is L6, and an angle between the center line L5 of the suction hole 1316 and the center line L7 of the bypass port 1317 is $\alpha$, and following condition is satisfied: $10° < \alpha < 15°$ (as shown in FIG. 11).

Figure 10:
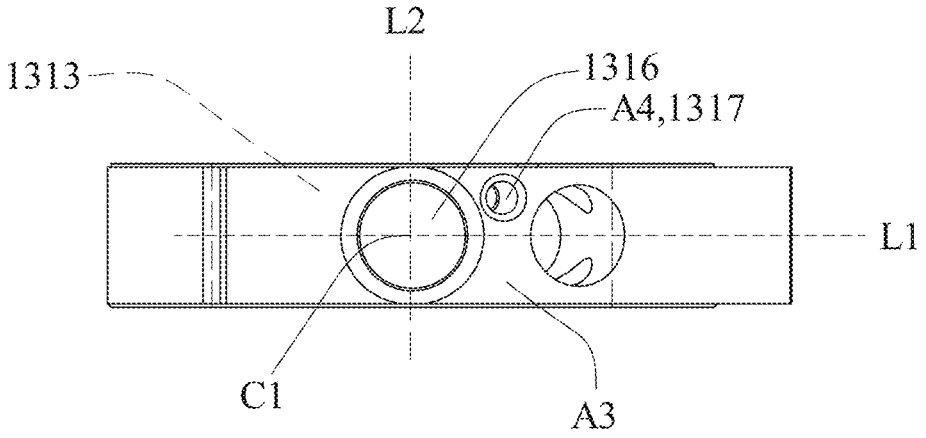
FIG. 10 is a schematic view of a fourth type structure of the cylinder of the rotary compressor of the present disclosure.

Type IV: Since the third area A3 and the fourth area A4 are located on the same side of the suction hole 1316, when the bypass port 1317 is located in the fourth area A4 (as shown in FIG. 10), the bypass port 1317 is communicated with the compression chamber 1313 or the suction hole 1316. In other words, the bypass port 1317 is communicated with the compression chamber 1313, or the bypass port 1317 is communicated with the suction hole 1316. In the embodiment, the bypass port 1317 is communicated with the suction hole 1316 (as shown in FIG. 11). Whether the bypass port 1317 is communicated with the compression chamber 1313 or the bypass port 1317 is communicated with the suction hole 1316, a center line of the suction hole 1316 is L5, a center line of the bypass port 1317 is L6, and an angle between the center line L5 of the suction hole 1316 and the center line L6 of the bypass port 1317 is $\alpha$, and the following condition is satisfied: $10° < \alpha < 15°$ (as shown in FIG. 11).

As described above, regardless of the structure the cylinder 131 of the compression pump 13, in the embodiment, a cross-sectional area of the suction hole 1316 is S1 and a cross-sectional area of the bypass port 1317 is S2, and the following condition is satisfied: $2 \leq S1/S2 \leq 300$.

Figure 12:
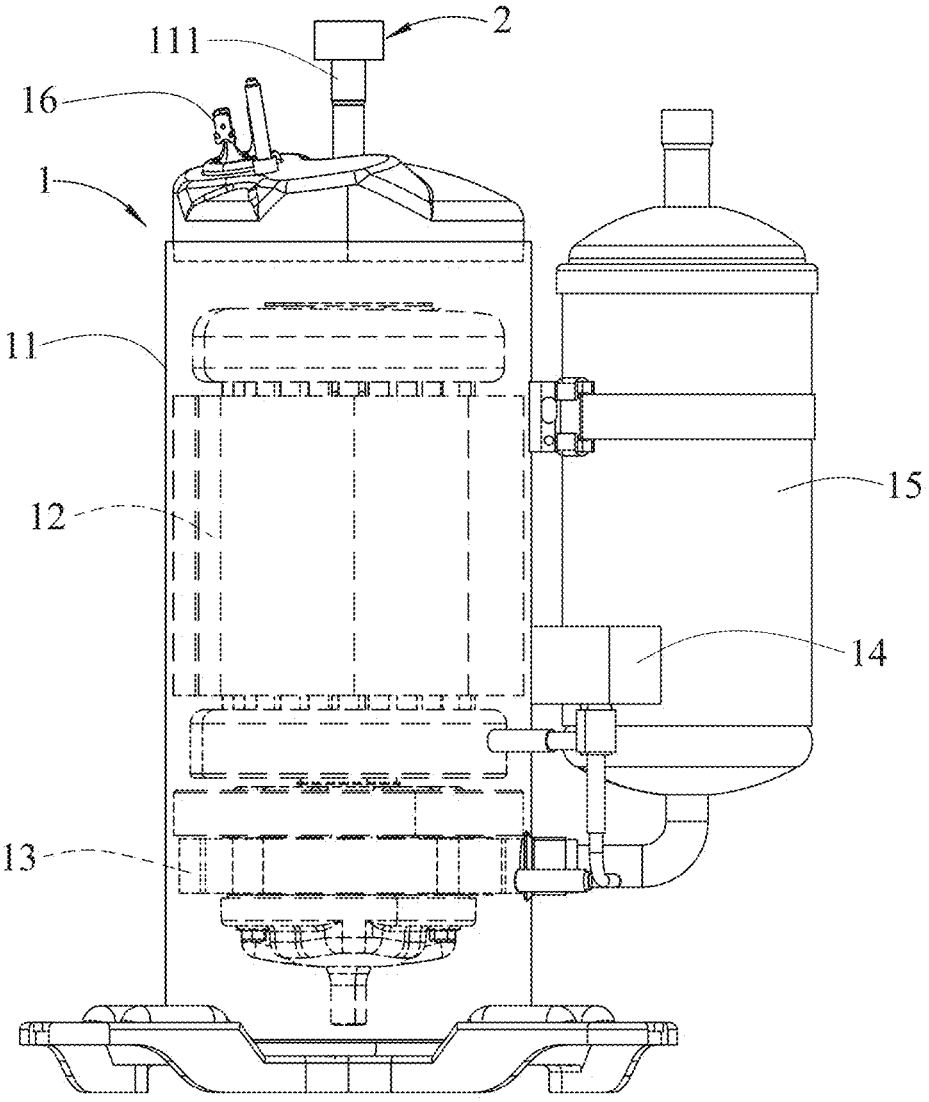
FIG. 12 is a schematic view (I) of the rotary compressor of the present disclosure.
Figure 13:
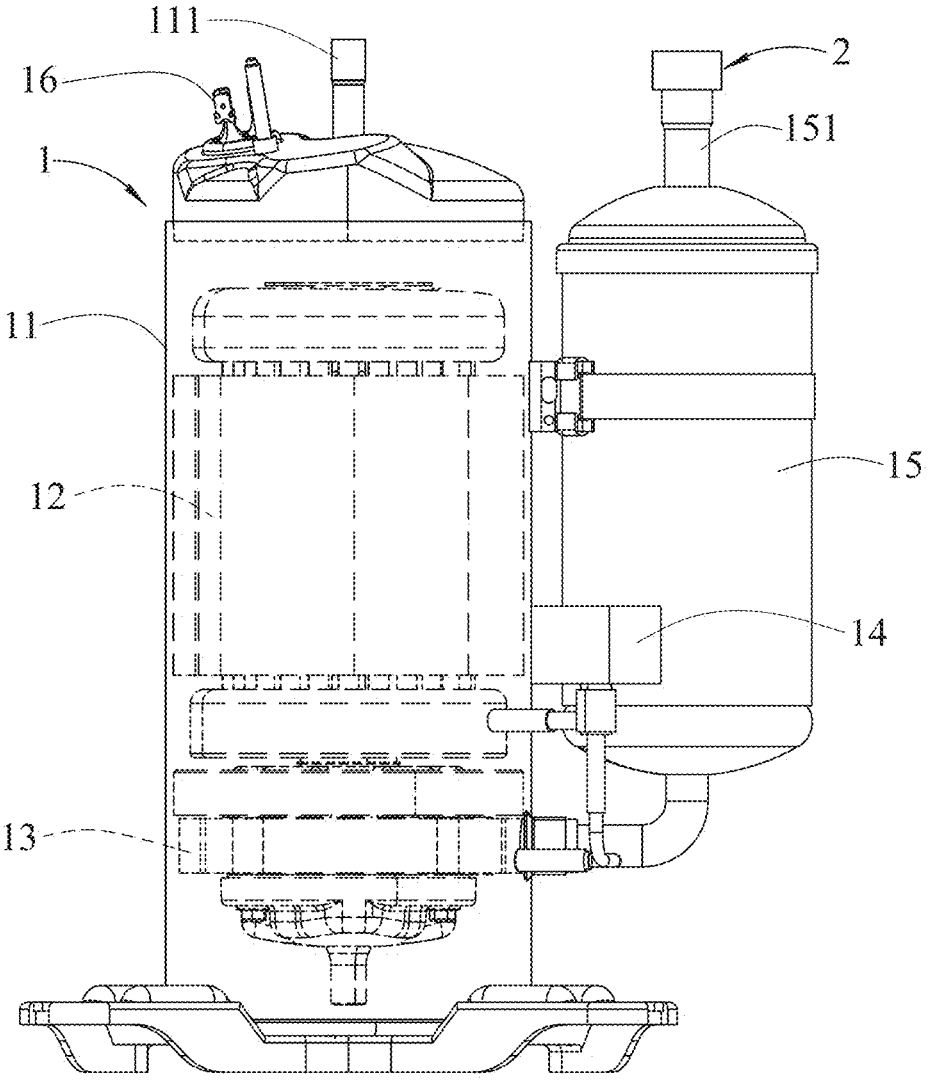
FIG. 13 is a schematic view (II) of the rotary compressor of the present disclosure.

Referring to FIG. 12 and FIG. 13, and FIG. 1 to FIG. 11 are herein incorporated by references. In the embodiment, the rotary compressor 1 further includes a check valve 2. The check valve 2 is disposed at the outlet pipe 111 of the housing 11 (as shown in FIG. 12) or the inlet pipe 151 of the filter bottle 15 (as shown in FIG. 13). When the check valve 2 is disposed at the outlet pipe 111 of the housing 11, the check valve 2 is located at either the exterior or the interior of the housing 11. In the embodiment, the check valve 2 is located at the exterior of the housing 11. Whether the check valve 2 is located at the outlet pipe 111 of the housing 11 or the inlet pipe 151 of the filter bottle 15, the structure of the housing 11 of the rotary compressor 1, the motor 12, the compression pump 13, the high-pressure chamber communication unit 14, the filter bottle 15, and the electrical connector assembly 16 have already been described in the foregoing paragraphs, and therefore will not be described again.

Under the structure described above, when the rotary compressor 1 is not in a start-up state, at 0~180 seconds prior to the start-up, the solenoid valve 141 of the high-pressure chamber communication unit 14 is pre-activated, so that the low-density refrigerant gas in the housing 11 of the rotary compressor 1 is transferred to the bypass port 1317 through the connecting tube 142 located in the inner space of the housing 11, and finally enters into the compression chamber 1313 of the cylinder 131 of the compression pump 13. And When the electrical connector assembly 16 of the rotary compressor 1 is supplied to the stator 121 of the motor 12, the stator 121 drives the rotor 122 to rotate and drive the crankshaft 137 to rotate eccentrically, so that the eccentric portion 1371 of the crankshaft 137 drives the ring 132 to rotate in the cylinder 131, which reduces the mass of the refrigerant in the suction-compression-exhaust cycle, and at the same time, reduces the high and low pressure difference during the start-up period. When the time is up, the solenoid valve 141 is closed to reduce the start-up and maximum torque required during the period, and the upper support 135 and lower support 136 are supported by the upper shaft section 1372 and lower shaft section 1373 of the crankshaft 137 and operate at a high speed, so that the compression pump 13 is in an operation state. With the ring 132 rotates eccentrically, the low-pressure refrigerant flowing into the inlet pipe 151 of the filter bottle 15 is sucked into the compression chamber 1313 of the cylinder 131 of the compressor pump 13 through the inner pipe 152 of the filter bottle 15, and is continuously compressed to a certain pressure, and then the high-pressure refrigerant in the compression chamber 1313 is exported to the inner portion of the housing 11. The above-exhausted high-pressure refrigerant can move upward through the gap between the housing 11 and the stator 121 of the motor 12, or the gap between the stator 121 and the rotor 122, and finally be exhausted out of the refrigeration circulation system through the outlet pipe 111 of the housing 11. By repeating the cycle, the high-efficiency and low-torque motor 12 can enhance the energy efficiency of the rotary compressor 1.

In sum, the present disclosure provides a rotary compressor 1 that utilizes the activation of the high pressure chamber communication unit 14 to reduce the mass and the flow of refrigerant in the compression chamber 1313 of the cylinder 131 of the compression pump 13 during the start-up period; and at the same time reduces the difference between the high and low pressures and reduces the start-up torque/operating torque required during the start-up period, so that the low torque high efficiency motor 12 can be smoothly applied to the high efficiency rotary compressor 1 to enhance the efficiency of the rotary compressor 1.

The advantages of the present disclosure according to the above structure: when the rotary compressor 1 is not in the start-up state, the solenoid valve 141 of the high-pressure chamber communication unit 14 is activated, so that the low-density refrigerant gas in the housing 11 of the rotary compressor 1 will be transferred to the bypass port 1317 through the connecting tube 142 located in the inner space of the housing 11 and enters the compression chamber 1313 of the cylinder 131 of the compression pump 13 at 0~180 seconds prior to the start-up time, which reduces the mass of the refrigerant in the suction-compression-exhaust cycle, and at the same time reduces the high and low pressure difference during the start-up period. The solenoid valve 141 is closed when the time up to reduce the start-up and maximum torque required during the period, so that the high efficiency low torque motor can enhance the energy efficiency of the rotary compressor 1.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A rotary compressor comprising:

a housing comprising an outlet pipe;

a motor located in the housing;

a compression pump located in the housing and below the motor, the compression pump comprising:

a cylinder comprising a first end portion and a second end portion, the cylinder comprising a compression chamber located in a center of the cylinder and running through an upper and a lower end of the cylinder, a wall of the compression chamber including a vane groove, a spring hole, a suction hole and a bypass port, wherein the spring hole is communicated with the vane groove; and wherein the suction hole, the vane groove and the spring hole are independent of each other and are not communicated with each other;

a ring rotatably located in the compression chamber of the cylinder;

a vane reciprocally moved in the vane groove of the cylinder, a front end of the vane and a peripheral surface of the ring are in contact with each other;

at least one spring located at a back end of the vane;

an upper support located in the housing and above the cylinder;

a lower support located in the housing and below the cylinder; and a crankshaft located in the housing for disposing the upper support, the motor, the ring and the lower support; and a high-pressure chamber communication apparatus located on one side of the housing, wherein the high-pressure chamber communication apparatus is communicated with the housing and with the bypass port of the cylinder of the compression pump, so as to enable a refrigerant gas inside the housing flow to the bypass port and flow enter into the compression chamber.

2. The rotary compressor of claim 1, wherein the high-pressure chamber communication apparatus comprises a solenoid valve and two connecting tubes, the solenoid valve is connected with the two connecting tubes and is located outside the housing, wherein one of the connecting tubes extends into the housing, and the other of the connecting tubes is communicated with the bypass port of the compression pump.

3. The rotary compressor of claim 1, wherein the suction hole, the bypass port, the vane groove and the spring hole are located at the first end portion, the suction hole and the vane groove are communicated with the compression chamber, and the bypass port is communicated with the compression chamber or the suction hole.

4. The rotary compressor of claim 3, wherein a first imaginary line and a second imaginary line are defined, the first imaginary line extends left and right, the second imaginary line extends top and down, and the first imaginary line and the second imaginary line intersect at a center of the suction hole, thereby defining a first area, a second area, a third area and a fourth area around the suction hole.

5. The rotary compressor of claim 4, wherein when the bypass port is located in the first area or the second area, a center line of the suction hole is L3, a center line of the bypass port is L4, and an angle between the center line of the suction hole and the center line of the bypass port is α, and the following condition is satisfied: $10° < \alpha < 70°$.

6. The rotary compressor of claim 4, wherein when the bypass port is located in the first area or the second area, the bypass port is L-shaped and communicated with the suction hole.

7. The rotary compressor of claim 4, wherein when the bypass port is located in the third area or the fourth area, a center line of the suction hole is L5, a center line of the bypass port is L6, an angle between the center line of the suction hole and the center line of the bypass port is α, and the following condition is satisfied: $10° < \alpha < 15°$.

8. The rotary compressor of claim 1, further comprising a filter bottle, wherein the filter bottle comprises an inlet pipe at a top end thereof and at least one inner pipe therein, the inner pipe extends from an outside of the filter bottle and into the housing and is communicated with the suction hole of the cylinder of the compression pump, so that the filter bottle is located on one side of the housing.

9. The rotary compressor of claim 8, further comprising a check valve, wherein the check valve is located at the outlet pipe of the housing or the inlet pipe of the filter bottle.

10. The rotary compressor of claim 9, wherein when the check valve is located in the outlet pipe of the housing, the check valve is located on an outside of the housing or on an inside of the housing.

* * * * *